US005752702A

United States Patent [19]

McDoniel

[11] Patent Number: 5,752,702

[45] Date of Patent: May 19, 1998

[54] RISK LIMITING ADDITIONAL PARTICIPATION POKER GAME

[76] Inventor: Donald L. McDoniel, 7506 Widgeon, Fair Oaks, Calif. 95628

[21] Appl. No.: 851,195

[22] Filed: May 5, 1997

[51] Int. Cl.[6] ..... A63F 1/00

[52] U.S. Cl. ..... 273/292

[58] Field of Search ..... 273/292, 274, 273/309; 463/13

[56] References Cited

U.S. PATENT DOCUMENTS

| | | | |
|---|---|---|---|
| 5,249,809 | 10/1993 | Wolf | 273/274 |
| 5,314,194 | 5/1994 | Wolf | 273/292 |
| 5,452,900 | 9/1995 | Skratulia et al. | 273/292 |

OTHER PUBLICATIONS

Scarne's Encyclopedia Of Games, John Scarne, Harper & Row Publishers, pp. 14–18, 33–37, 52, 1973.

*Primary Examiner*—Benjamin H. Layno

*Attorney, Agent, or Firm*—John P. O'Banion

[57] ABSTRACT

A method for playing a modified multiple betting round card game wherein a player has the opportunity to "cap" his/her bet, i.e., limit his/her risk by placing a ceiling on the amount the player wishes to bet. Once a player has initiated a hand, the player may check, call, bet, raise, or cap during subsequent betting intervals while maintaining his/her eligibility to win the bets placed and forfeited by other players during the betting intervals which the player successfully completed. The bets placed by each player during each betting interval are kept separate and are organized according to betting columns printed on a game table. When the hand is finished, the dealer settles all bets made during each individual betting interval. Beginning with the last betting interval, the dealer awards all bets placed and forfeited to the player with the strongest hand who successfully completed the final betting interval. The dealer then settles the remaining intervals working from last to first.

7 Claims, 2 Drawing Sheets

RISK LIMITING ADDITIONAL PARTICIPATION POKER GAME

BACKGROUND OF THE INVENTION

1. Field of the Invention

The present invention pertains generally to a method for playing card games, and more particularly to a modified multiple betting round Poker game wherein a player has the opportunity to "cap" his/her bets, i.e., limit his/her risk by placing a ceiling on the amount the player wishes to bet. Once a player has "capped" his/her bet, the player may continue to participate to the conclusion of that particular hand without betting beyond his/her cap.

2. Description of the Background Art

Poker is a card game played in various forms throughout the world. Its popularity is greatest in the English-speaking countries and, after the 1850s, it was called the "national card game of the United States . . ." For nearly a hundred years in the United States, Poker was considered a gambling game for men, unsuited to polite or mixed gatherings. But, after the 1920s, its popularity extended to both sexes and all levels of society. Surveys made in 1956 showed Poker to be the favorite U.S. game among men, and the third-most-favored (after rummy and bridge) among women.

The principle of Poker is very ancient. One of its ancestral games (Sp. Primero, It. primera, Fr. la prime) appears in literature at least as early as 1526. In this early game, each player had three cards, and the counting combinations were three of a kind, a pair, and a flux or flush (three cards of the same suit). In later developments, certain cards had special value, equivalent to wild cards in modern Poker. By about 1700 the betting and bluffing aspects had produced the game "Brag" in England (one of four card games about which Edmond Hoyle wrote) and pochen (Ger. "To bluff") in Germany. From the latter, the French developed a similar game called poque, played in French America in 1803, when the Louisiana Purchase made New Orleans and its environs a territory of the United States. During the next twenty years, English-speaking settlers in the Louisiana territory adopted the game, anglicized its name to Poker and established the essential features of the modern game. The game spread up river from New Orleans via steamboats. As card games were originally played extensively on these river boats, playing-card companies used the common-property trade names "Steamboat Playing Cards."

In one respect, Poker is a family of games rather than a single game. It is played in countless variants and at least 150 are named and described in the literature of the game. All forms of Poker, however, share certain essential features. A Poker hand comprises five cards. The value of a hand is in inverse proportion to its mathematical frequency; that is, the more unusual the combination of cards, the higher the hand ranks. The value of a hand is also affected by the rank of individual cards that make up each hand, i.e., higher ranked cards make one hand more highly ranked than another hand that occurs with the same mathematical frequency but comprises lower ranked cards. Each player may bet that he has the best hand, and other players must "call," meet his bet or drop. Therefore a player may "bluff" by betting he has the best hand when in fact he does not, and he may win by bluffing if the other players holding superior hands do not call his bet.

Poker is truly a game of competition, perhaps one reason for its solid popularity among the competition-loving Americans. In fact, in 1925 a doctoral dissertation in psychology was written using the game of Poker for a study of the "aggressive behavior in a small social group; bluffing, risking, and the desire to win being studied by the use of Poker game as an experimental technique." The whole idea of the game is for an individual to play the cards received in such a manner that in the long run, when fortune blesses all with equal card holdings, the player win the most (usually money) from his or her opponents. A fact that is probably less appreciated is that "Poker is a game of skill second to none."

Any number of players from two to thirteen may participate in some of the various forms of Poker. Since more players produce more action, many consider 7 to 8 players to constitute an ideal game. Most of the popular variations can comfortably accommodate eight; some variations can accommodate more.

The idea is the same behind every variation; the hope is to accumulate a five-card hand which will outrank those held by one's opponents. Thus, while played in innumerable forms, Poker requires an understanding of only two basic things, the value of the Poker hands and the principles of betting. The object of the game is to win the pot. The pot is composed of all bets made by all players in any one deal.

Each bet means that the player thinks or hopes he has the best hand. When every player has acted on each betting round, the players show their hands and the best hand wins the pot.

In the course of each Poker deal, there will be one or more betting rounds in which the players have an opportunity to bet on their hands.

Before the cards are even dealt, the rules of the Poker game being played may require that each player put an initial bet (called an ante) into the pot.

Each betting interval begins when any player in turn makes a bet of one or more chips. Each player in turn after him must either call that bet (by putting into the pot the same amount of chips); or may raise, which means that the player puts in more than enough chips to call; or may drop or fold, which means that the player puts no chips into the pot, discards his hand and is out of the betting until a new hand is dealt. When a player folds, he loses all the chips he had previously put into that pot. Unless a player is willing to put into the pot at least as many chips as any player before him has put in, he must drop.

A betting interval ends when the bets have been equalized; that is, when every player has put into the pot exactly as many chips as each other player has put into the pot. There are usually two or more betting intervals for each Poker deal. After the final betting interval each player who has met the bets shows his hand face up on the table, and the best hand takes the pot. This is called the showdown.

If at any time a player makes a bet or raise that no other player calls, that player wins without showing his hand. "Check" is a Poker term that means a player wishes to remain in the pot without betting. In effect it is "a bet of nothing." A player may check provided that no player before him in that betting interval has made any bet. If any other player has bet, he must at least call the amount bet. If all players check, the betting interval is over.

In each betting interval, one player is designated as the first better, according to the rules of the game. The turn to bet moves from player to player from the left of the dealer, and no one may check, bet, or even drag, except when his turn comes.

In Stud poker, each player receives one or more hole cards, face down, and all but the final card face up. After each player is dealt at least one up card, and after each round of dealing (one card per player), there is a betting interval before the dealing is resumed.

In Seven Card Stud, two to seven may play. In the initial deal, each player receives two cards face down and then one card face up, all dealt one at a time in a clockwise rotation. There is then a betting interval. Each active player then receives three more face up cards and one more face-down card in the order with the deal interrupted for a betting interval after each round of cards is dealt. In the showdown, each player turns up all of his hole cards and selects five of his seven cards as his hand. These five cards must be separated from the other two which are not played. The cards then speak for themselves, as in any other form of Poker. The highest ranking hand will then be awarded the pot.

One of the variations of Poker, called "Hold Em," is played slightly differently. Each player receives two cards face down. The first betting interval then occurs. Three cards are then dealt to the center of the table face up. These center cards are called community cards and are used in common with all the other players. There is then a second betting interval after the three community cards are exposed. The last two cards are community cards and are also turned face up, one at a time, with a betting interval following the turning of each card. Each player makes his hand from his own two cards, plus the five community cards turned up in the center of the table.

It can be readily appreciated from the above disclosure as to the conventional manner of play of Poker, a round of the game consists of each player having to either call the bet (matching the largest bet made by any other player during that betting interval); raise the bet (betting more than any other bet made by any other player during that betting interval) or drop (making no bet, discarding the hand and withdrawing from play until there is another deal, and the player receives a new hand).

Thus, a player's opportunity to win is limited by the necessity of either risking all of the amounts bet or forfeiting all rights to the pot during that hand of play.

BRIEF SUMMARY OF THE INVENTION

The present invention pertains to a method for playing card games with multiple betting intervals which allows players to limit or "cap" their bets without the usual consequences involved in "dropping" or "folding," i.e., a player who caps their bets continues to play the rest of the hand and maintains their eligibility to win that portion of the pot associated with the betting intervals which that player successfully completed.

In general terms the invention comprises a method for playing a Poker game wherein bets are made by players in the conventional way, except that bets made during each betting interval are kept separated, thereby creating wholly independent betting intervals with corresponding independent pots. To initiate participation in any hand, a player must successfully complete the first betting interval, i.e., the player must call or match the highest bet placed during the first betting interval. During subsequent betting intervals, a player may bet, raise, check, cap or drop. Players who cap during subsequent betting intervals may continue to play to the end of the hand, and remain eligible to win bets placed during those betting intervals which they successfully completed.

If a player bets at the beginning of any betting interval, that player must at least call all other larger bets made during that betting interval to successfully complete the interval. If a player places a bet during a particular betting interval, then refuses to call other higher bets placed by other players during that interval, the player refusing to call must drop and forfeit all bets in all betting intervals. A variation of this rule could be that the dropping player only forfeits prior bets in the current betting interval instead of those made in all prior betting intervals.

If a player elects to "cap" his/her bet, he/she is allowed to remain in the game or hand. The player is able to, in effect, wager whatever amount has already been bet against the other players' hands. The hand is then played out, and settlement is made in the conventional fashion. The players who cap their bets before the completion of a hand thereby limit the amount they can win to the bets placed by the other players up to the last betting interval successfully completed by the capping player. This strategy allows a player with less money or a weaker hand to play the hand completely through and not be forced out of play by excessive betting and/or raising by those players with more money. Moreover, a player cannot be shut out of any hand they desire to play provided the player has successfully completed the first betting interval. As can be seen, this invention offers a far greater diversification of the game as presently played.

By way of example, and not of limitation, the card games commonly known as "Seven Card Stud" and "Texas Hold-Em," may be modified according to the invention. For example, for a modified form of Texas Hold-Em, the game is started by the initial deal where each player receives two cards face down, all dealt in a clockwise rotation. Then there is a betting interval. Each active player may bet, raise, check, call, drop or, if they have money in the pot from ante or a previous bind bet, "cap" their hand. Once a player has completed the first betting interval, i.e., at least called all other bets made during that betting interval or capped during that interval, that player may continue to participate in that hand, regardless of whether they drop during a later betting interval provided that they call all bets made during subsequent intervales or they cap their bet at the beginning of that later interval. When the first betting interval is completed, the dealer then deals three "community cards," which are cards that all players may use in conjunction with the cards they hold individually. After this, the second betting interval begins. Each player again may bet, raise, check, call or drop. However, a player may also cap their bet upon their first opportunity to place a bet in that particular betting interval. If a player chooses to cap their bet at this point, that player does not have to place any more bets during the hand, and may continue to participate in the hand until the end of that hand. Any player that chooses to cap their bet at such a time limits their potential winnings to the total of all bets placed by all players in all preceding betting intervals. In this example, the player who chooses to cap in the second betting interval is limited to potentially winning the bets placed by the other players in the first betting interval only. Once the second betting interval is completed, the dealer deals the fourth community card face up.

After the fourth community card is dealt, the third betting interval begins. In this interval, players may bet, raise, call, drop or cap, as in the second betting interval. After the third betting interval is completed, the dealer deals the final community card face up. The fourth betting interval proceeds similarly to the others and occurs after the fifth community card is turned up. In modified Texas Hold-Em this would be the final betting interval, while in modified Seven Card Stud, there would be an additional round of betting that would occur after the sixth community card is turned up. Once the final bets have been placed, all cards are exposed for the "showdown."

After the "showdown," the dealer works backwards through the betting intervals to settle the bets. In the case of modified Texas Hold-Em or another game where betting is limited to four intervals, the dealer begins with the fourth betting interval and compares the strength of the hands of only those players who successfully completed the fourth betting interval. In other words, the players who "capped" their bets at the beginning of the fourth betting interval are not considered as players with respect to the bets placed during the fourth betting interval. Of those players who did complete the fourth betting interval, the player with the strongest hand wins all bets placed and forfeited during that betting interval.

Next, the dealer compares the strength of the hands of only those players who completed the third betting interval, and awards all bets made and forfeited during the third interval to the player with the strongest hand. This is repeated until the dealer settles all bets from all betting intervals.

A further advantage of the modified card game of this invention is that it is visually different than traditional Poker games of which Applicant is aware, a result of the unique layout design of the table on which it is intended to be played. This modified version of the game is usually easier to follow, for both players and the dealer, who can observe more quickly and clearly exactly where each player has stopped their betting. It adds a totally new dimension to game strategy.

An object of the invention is to provide a modified version of the traditional card games that involve multiple intervals of betting without the major limitation imposed by all of the currently known variations.

Another object of the invention is to provide a modified Poker game wherein a player has the opportunity to maximize his or her playing options.

A further object of the invention is to provide a modified version of multiple betting interval card games that, in effect, afford the players the opportunity to play the hand completely through all rounds of betting regardless of the maximum amount they wish to bet by capping their bet at the beginning of any betting round, thereby avoiding risking more than they wish to risk.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawing which is for illustrative purposes only.

DETAILED DESCRIPTION OF THE INVENTION

Figure 1:
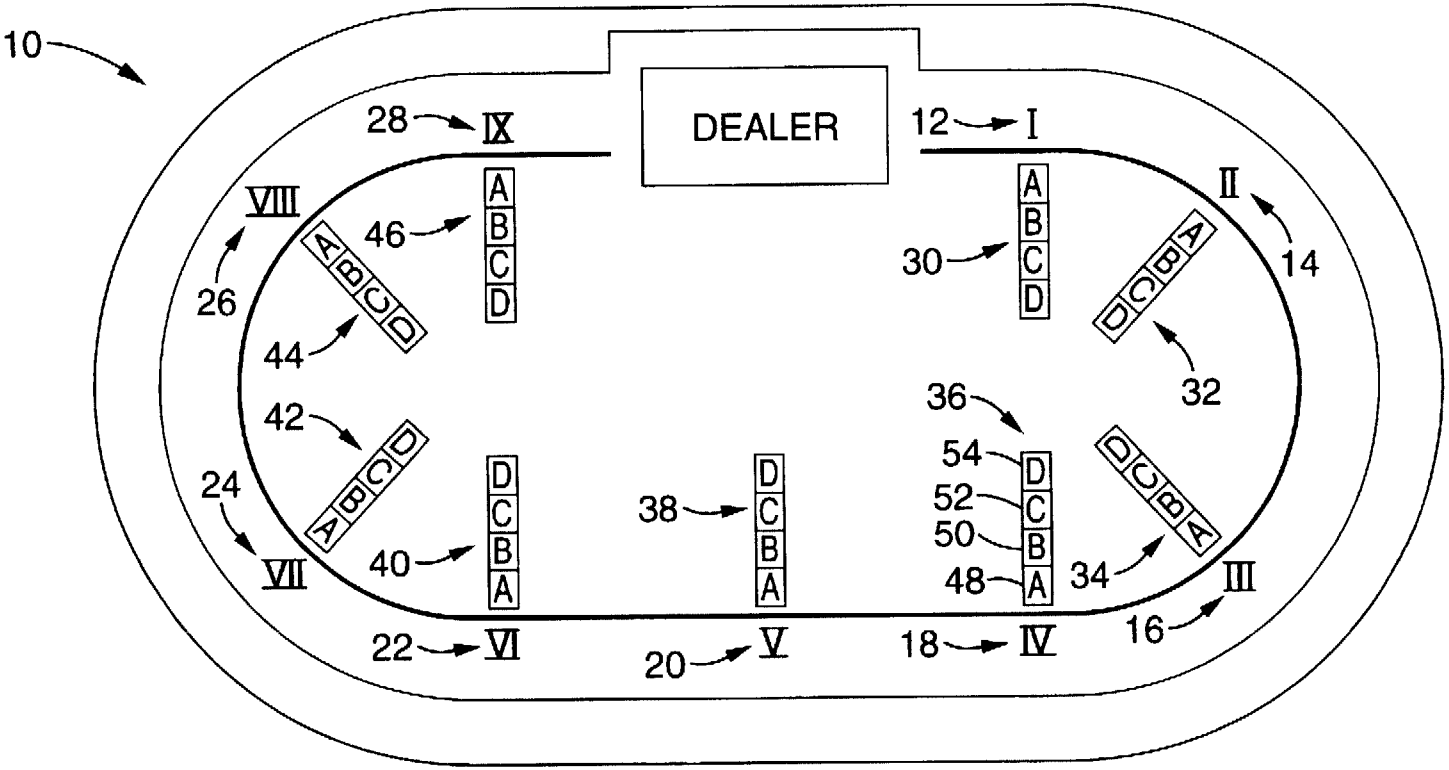
FIG. 1 is a top plan view of a gaming table for playing a modified form of Texas Hold-Em in accordance with the present invention.

Referring to FIG. 1, a gaming table 10 that may be used for playing a modified form of Texas Hold-Em in accordance with the present invention is generally shown. Table 10 is generally of a standard oval-shape, commonly used for gaming tables in casinos, and is configured for nine players and four betting rounds. For Texas Hold-Em, table 10 may be modified to allow eight through thirteen players and two through six betting rounds. It will be appreciated, however, that the invention is suitable for use with any number of betting intervals equal to or greater than two, and with various numbers of players.

As shown in FIG. 1, table 10 is provided with a nine playing stations 12, 14, 16, 18, 20, 22, 24, 26, 28, each of which are labeled with a Roman numeral, although any sequential indicia may be used. Each station 12 through 28 is provided with identical betting columns 30, 32, 34, 36, 38, 40, 42, 44, 46. Each betting column 30 through 46 is preferably subdivided into four betting positions, such as positions 48, 50, 52, and 54 of column 36. The positions are sequentially labeled with the letters A, B, C, and D, however, any sequential indicia may be used. The positions are preferably arranged such that the position labeled A is closest to the perimeter of table 10, and the position labeled D is closest to the center of table 10. Betting columns 30 through 46 are preferably arranged radially around the center of table 10.

A modified Texas Hold-Em Poker game in accordance with the present invention is started by an initial dealing of cards where each player sitting at one of stations 12 through 28 receives two cards face down, all dealt in a clockwise rotation. Then there is a first betting interval where each player may bet or check their hand. Players who wish to bet then place their respective bets in their respective betting area labeled A. Once a player has successfully completed the first betting interval, that player may continue to participate in that hand, regardless of whether he/she checks or "caps" during a later betting interval. When the first betting interval is completed, the dealer then deals three "community cards" face up into the middle of table 10. These community cards may be used by all players in conjunction with the cards they hold individually. After this, the second betting interval begins. Each player who wishes to bet, places his/her bet, in turn, in his/her respective second betting position labeled B. Alternatively, instead of betting a player may "cap" his/her bet upon his/her first opportunity to place a bet in that particular betting interval. If a player chooses to "cap" his/her bet at this point, that player does not have to place any more bets, and may continue to participate in the hand until the end of that hand. Any player who chooses to "cap" his/her bet at such a time limits their potential winnings to the total of all bets placed and forfeited by all players in all preceding betting intervals. In this example, the player who chooses to "cap" in the second betting interval is limited to winning the bets placed in the first betting interval only. Once the second betting interval is completed, the dealer deals a fourth community card face up to the dealer's right of the first three community cards.

After the fourth community card is dealt, the third betting interval begins. In this interval, players may bet, raise, call, or drop, similarly as in the second betting interval, except that these bets are placed in the third betting position labeled C. After the third betting interval is completed, the dealer deals a fifth and final community card face up to the dealer's right of the previous four community cards. The fourth and final betting interval proceeds similarly to the others except bets are placed in the fourth betting position labeled D. Once the final bets have been placed, all cards are exposed for the "showdown."

After the "showdown," the dealer works backwards through the betting intervals to settle the bets. In this example, the dealer begins with the fourth betting interval and compares the strength of the hands of only those players who successfully completed the fourth betting interval. In other words, the players who "capped" their bets at the beginning of the fourth betting interval are not considered as players with respect to the bets placed during the fourth betting interval. Of those players who did complete the fourth betting interval, the player with the strongest hand wins all bets placed and forfeited during that betting interval. Because all bets made by players who bet or forfeited bets during the fourth betting interval were placed in the positions labeled "D" the dealer simply awards all bets he finds in those positions to the player with the strongest hand who successfully completed that interval.

Next, the dealer compares the strength of the hands of only those players who completed the third betting interval, and awards all bets found in position C to the player with the strongest hand who successfully completed that betting interval. This is repeated until the dealer settles all bets from all betting intervals.

Figure 2:
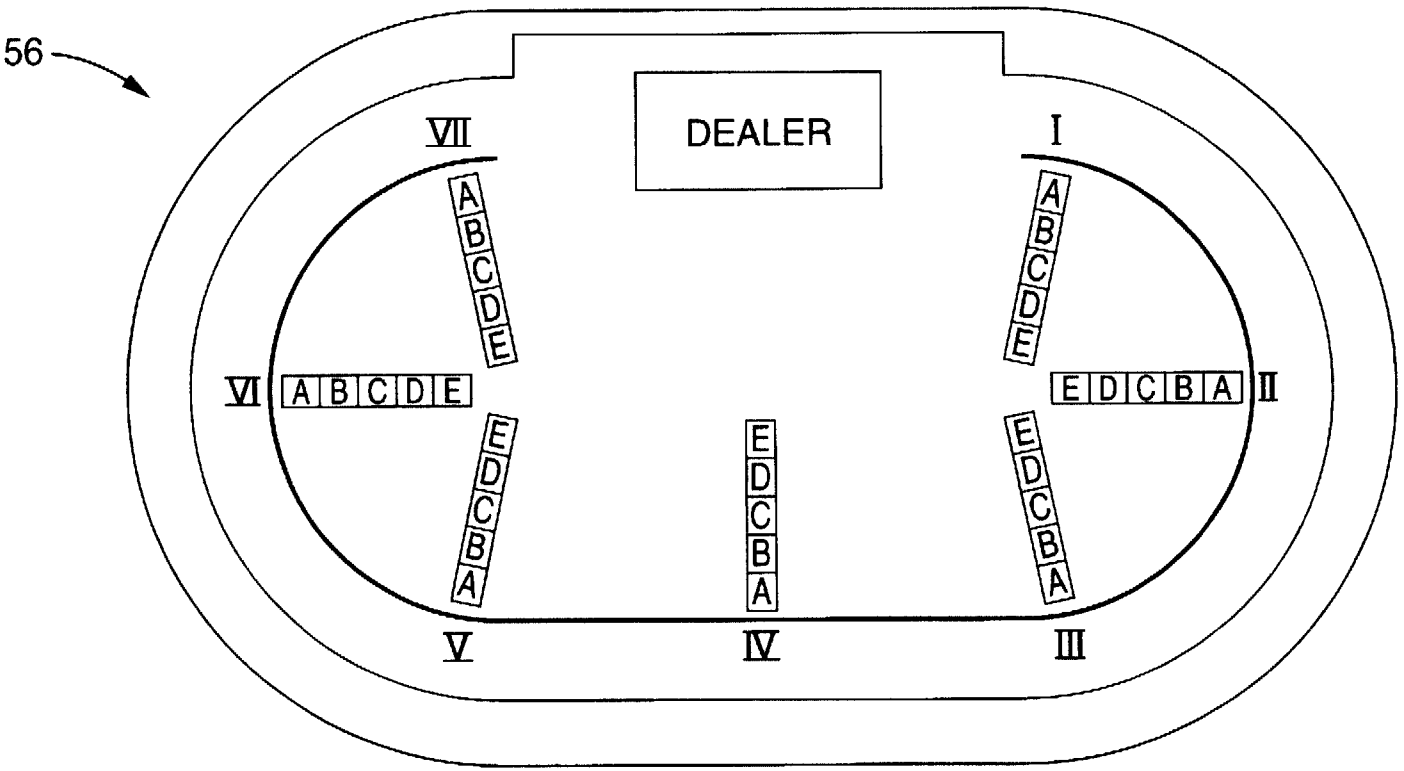
FIG. 2 is a top plan view of a gaming table for playing a modified form of Seven Card Stud in accordance with the present invention.

Those skilled in the art will appreciate that the present invention can be practiced in any card game that has multiple betting intervals, such as Stud Poker, Seven Card Stud Poker, Draw Poker, as well as many others, and that the gaming table used would vary accordingly. For example, FIG. 2 shows a gaming table 56 that is configured for Seven Card Stud Poker with seven players and five betting rounds, although table 56 could be modified to allow seven or more players and two or more betting rounds in other variations.

As can be seen, therefore, at each betting interval a player has the option of checking their hand (not betting) or betting the hand. If all of the players check their hands, the dealer proceeds to the next dealing round. If any player in the first betting position places a bet, the next player with an active hand may "cap" it and not place any additional money in the pot, call the bet, or call and raise the bet previously made. However, if the player caps the et, that player can only whatever chips or money are in the pot prior to the player capping his or her bet. If the player raises a previously made bet, any subsequent player who has not yet acted on his or her hand during that round of betting may cap the bet, or call or raise the bet previously made. If the player calls any bet during any round, the player must call all bets during that round, or surrender any/all rights to chips or money during that hand. Alternatively, this rule could be modified so that the dropping player only forfeits prior bets in the current betting interval instead of those made in all prior betting intervals. Furthermore, a player may not cap a bet during any round where he or she has previously made a bet, called a bet or raised a bet. In other words, a player may only cap a bet at his or her first opportunity to act on their hand, which is at the beginning of each betting round.

Accordingly, it will be seen that this invention provides a method for poker players to limit risk during a hand of poker, without losing the opportunity to finish the hand and potentially win a portion of the bets placed during the hand. The invention differs significantly from traditional Poker where a player must risk all of his or her chips/money on the table or forfeit all rights to the chips/money. Instead, a player can continue to enjoy the "play of the game" without making any further bets or risking an additional stake.

Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A method of playing a multi-player card game having a plurality of independent sequential betting intervals, comprising the steps of:

(a) at a player's first opportunity to bet during a betting interval, permitting said player to elect not to place a bet and to cap said player's betting risk at that player's current bet level; and (b) permitting said player to continue to play said game without making a bet in subsequent betting intervals.

2. A method as recited in claim 1, further comprising the step of:

(c) at the end of a final betting interval, settling bets made during each independent betting interval in reverse sequence, said settling of bets being carried out according to the winning hand held by only those players who participated in betting during the betting interval being settled.

3. A method of playing a multi-player card game having a plurality of sequential betting intervals, comprising the steps of:

(a) dealing each player a hand of cards;

(b) allowing each player to place a bet for said player's hand;

(c) allowing each player to continue to bet until each betting interval is completed;

(d) at a player's first opportunity to bet during a betting interval after a first betting interval, allowing each player to elect not to place a bet and to cap said player's betting risk at that player's current bet level; and (e) permitting said player to continue to play said game without making a bet in subsequent betting intervals.

4. A method as recited in claim 3, further comprising the step of:

(f) at the end of a final betting interval, settling bets made during each betting interval in reverse sequence, said settling of bets being carried out according to the winning hand held by only those players who participated in betting during the betting interval being settled.

5. A method as recited in claim 3, wherein once a player bets during any betting interval, said player must match the highest bet placed by the other participating players during that interval or forfeit any bet already placed during that interval.

6. A method of playing Seven Card Stud Poker, comprising the steps of:

(a) dealing each player two cards face down and a third card face up;

(b) completing a first betting interval;

(c) dealing a fourth card face up to each player;

(d) completing a second betting interval wherein, at a player's first opportunity to bet during said second betting interval, said player is allowed to elect to cap said player's hand and continue to play said hand without betting, and wherein a capping player is deemed to have successfully completed only said first betting interval;

(e) dealing a fifth card face up to each said player;

(f) completing a third betting interval wherein, at a player's first opportunity to bet during said third betting interval, said player is allowed to elect to cap said player's hand and continue to play said hand without betting, and wherein a capping player is deemed to have successfully completed only said first and second betting intervals;

(g) dealing a sixth card face up to each said player;

(h) completing a fourth betting interval wherein, at a player's first opportunity to bet during said fourth betting interval, said player is allowed to elect to cap said player's hand and continue to play said hand without betting, and wherein a capping player is deemed to have successfully completed only said first, second and third betting intervals;

(i) dealing a seventh card face up to each said player;

(j) completing a fifth betting interval wherein, at a player's first opportunity to bet during said fifth betting interval, said player is allowed to elect to cap said player's hand and continue to play said hand without betting, and wherein a capping player is deemed to have successfully completed only said first, second, third and fourth betting intervals;

(k) settling bets made during said fifth betting interval wherein said dealer compares the strength of the hands held by each player who successfully completed said fifth betting interval, and awarding all bets made or forfeited by players during said fifth betting interval to the player with the highest hand who successfully completed said fifth betting interval;

(l) settling bets made during said fourth betting interval wherein said dealer compares the strength of the hands held by each said player who successfully completed said fourth betting interval, and awarding all bets made or forfeited by players during said fourth betting interval to the player with the highest hand who successfully completed said fourth betting interval;

(m) settling bets made during said third betting interval wherein said dealer compares the strength of the hands held by each said player who successfully completed said third betting interval, and awarding all bets made or forfeited by players during said third betting interval to the player with the highest hand who successfully completed said third betting interval;

(n) settling bets made during said second betting interval wherein said dealer compares the strength of the hands held by each said player who successfully completed said second betting interval, and awarding all bets made or forfeited by players during said second betting interval to the player with the highest hand who successfully completed said second betting interval; and (o) settling bets made during said first betting interval wherein said dealer compares the strength of the hands held by each said player who successfully completed said first betting interval, and awarding all bets made or forfeited by players during said first betting interval to the player with the highest hand who successfully completed said first betting interval.

7. A method for playing Texas Hold-Em, comprising the steps of:

(a) dealing each player two cards face down;

(b) completing a first betting interval;

(c) dealing three community cards face up which may be used by each player in conjunction with the cards held by said player;

(d) completing a second betting interval wherein, at a player's first opportunity to bet during said second betting interval, said player is allowed to elect to cap said player's hand and continue to play said hand without betting, and wherein a capping player is deemed to have successfully completed only first said betting interval;

(e) dealing a fourth community card face up which may be used by each player in conjunction with the cards held by said player;

(f) completing a third betting interval wherein, at a player's first opportunity to bet during said third betting interval, said player is allowed to elect to cap said player's hand and continue to play said hand without betting, and wherein a capping player is deemed to have successfully completed only said first and second betting intervals;

(g) dealing fifth community card face up which may be used by each player in conjunction with the cards held by said player;

(h) completing a fourth betting interval wherein, at a player's first opportunity to bet during said fourth betting interval, said player is allowed to elect to cap said player's hand and continue to play said hand without betting, and wherein a capping player is deemed to have successfully completed only said first, second and third betting intervals;

(i) settling bets made during said fourth betting interval wherein said dealer compares the strength of the hands held by each said player who successfully completed said fourth betting interval, and awarding all bets made or forfeited by players who successfully completed said fourth betting interval to the player with the highest hand who successfully completed said fourth betting interval;

(j) settling bets made during said third betting interval wherein said dealer compares the strength of the hands held by each said player who successfully completed said third betting interval, and awarding all bets made or forfeited by players who successfully completed said third betting interval to the player with the highest hand who successfully completed said third betting interval;

(k) settling bets made during said second betting interval wherein said dealer compares the strength of the hands held by each said player who successfully completed said second betting interval, and awarding all bets made or forfeited by players who successfully completed said second betting interval to the player with the highest hand who successfully completed said second betting interval; and (l) settling bets made during said first betting interval wherein said dealer compares the strength of the hands held by each said player who successfully completed said first betting interval, and awarding all bets made or forfeited by players to the player with the highest hand who successfully completed said first betting interval.

* * * * *